US007117637B2

(12) United States Patent
Delgado et al.

(10) Patent No.: US 7,117,637 B2
(45) Date of Patent: Oct. 10, 2006

(54) PANEL GUIDE AND IMPACT SEPARATION SYSTEM FOR A SLIDING DOOR

(75) Inventors: Joe Delgado, West Bend, WI (US); Arno Klein, Nordstemmen (DE); Louis B. Mueller, Richfield, WI (US); Mark Semmann, Cedarburg, WI (US)

(73) Assignee: Rytec Corporation, Jackson, WI (US)

( * ) Notice: Subject to any disclaimer, the term of this patent is extended or adjusted under 35 U.S.C. 154(b) by 0 days.

(21) Appl. No.: 10/320,323

(22) Filed: Dec. 16, 2002

(65) Prior Publication Data

US 2003/0140564 A1 Jul. 31, 2003

Related U.S. Application Data

(60) Provisional application No. 60/341,408, filed on Dec. 14, 2001.

(51) Int. Cl.
*E05B 65/10* (2006.01)

(52) U.S. Cl. ..... 49/141; 49/360

(58) Field of Classification Search ..... 49/141, 49/360; 105/348
See application file for complete search history.

(56) References Cited

U.S. PATENT DOCUMENTS

| | | | |
|---|---|---|---|
| 1,205,707 | A | 11/1916 | Cahill |
| 1,960,860 | A | 5/1934 | Allen |
| 2,373,023 | A | 4/1945 | Goodwin |
| 2,425,016 | A | 8/1947 | Weaver |
| 2,658,571 | A | 11/1953 | Guth et al. |
| 2,912,236 | A | 11/1959 | Hallstrom, Jr. |
| 3,197,817 | A | 8/1965 | Voris |
| 3,348,337 | A | 10/1967 | Grasso |
| 3,802,480 | A | 4/1974 | Daggy |
| 3,805,450 | A | 4/1974 | Forcina |
| 3,810,656 | A | 5/1974 | Fox et al. |
| 3,834,081 | A | 9/1974 | Catlett |
| 4,030,246 | A | 6/1977 | Naylor |
| 4,058,191 | A | 11/1977 | Balbo |
| 4,134,178 | A | 1/1979 | Stevens |
| 4,427,049 | A | 1/1984 | Belanger et al. |

(Continued)

FOREIGN PATENT DOCUMENTS

DE 29808179 U1 * 7/1998

(Continued)

OTHER PUBLICATIONS

Wright, Carroll G., "*Cold Storage Doors*," The Construction Specifier v 48 n 4, Apr. 1995, 5 pages.

(Continued)

*Primary Examiner*—Jerry Redman
(74) *Attorney, Agent, or Firm*—Factor & Lake

(57) ABSTRACT

A panel guide and impact separation system for a sliding door adapted to open and close an opening having an upper and lower extent is disclosed. The system comprises a guide, a guide follower and an elongate beam. The guide is adapted to be mounted to a mounting surface located between the upper and lower extent. The guide follower is disposed in operable engagement with the guide and is adapted to translate along at least a portion of the guide. The elongate beam has a first and second end. The first end of the elongate beam is connected the guide follower and the second end of the elongate beam is attachable to a door panel. The second end of the elongate beam is adapted to extend generally horizontally along at least a portion of a vertical plane of a door panel.

29 Claims, 8 Drawing Sheets

U.S. PATENT DOCUMENTS

| | | | | |
|---|---|---|---|---|
| 4,619,075 | A | 10/1986 | Wiles | |
| 4,646,471 | A | 3/1987 | Shaiu | |
| 4,800,946 | A | 1/1989 | Rosenoy | |
| 4,882,876 | A | 11/1989 | Daugirdas | |
| 4,887,659 | A | 12/1989 | West | |
| 4,961,454 | A | 10/1990 | Reilly, Jr. et al. | |
| 5,025,846 | A | 6/1991 | West | |
| 5,143,137 | A | 9/1992 | West | |
| 5,295,527 | A | 3/1994 | West | |
| 5,301,468 | A | 4/1994 | Kamezaki | |
| 5,305,855 | A | 4/1994 | Rivera et al. | |
| 5,469,661 | A | 11/1995 | Finkelstein et al. | |
| 5,542,738 | A | 8/1996 | Walker et al. | |
| 5,573,298 | A | 11/1996 | Walker et al. | |
| 5,598,606 | A | 2/1997 | Jacobs | |
| 5,638,883 | A | 6/1997 | Schulte | |
| 5,742,979 | A | 4/1998 | Garcia-Hernando | |
| 5,887,385 | A * | 3/1999 | Horner et al. | 49/26 |
| 5,907,890 | A | 6/1999 | Redaelli | |
| 5,915,448 | A | 6/1999 | Schulte | |
| 6,089,305 | A * | 7/2000 | Gruben et al. | 160/271 |
| 6,095,229 | A * | 8/2000 | Kellogg et al. | 160/201 |
| 6,330,763 | B1 | 12/2001 | Kern et al. | |
| 6,336,248 | B1 | 1/2002 | Finkelstein et al. | |
| 6,615,898 | B1 * | 9/2003 | Schulte | 160/201 |
| 2003/0046870 | A1 * | 3/2003 | Langenbach | 49/141 |
| 2004/0261318 | A1 * | 12/2004 | Berry et al. | 49/209 |
| 2005/0150169 | A1 * | 7/2005 | Schulte et al. | 49/410 |

FOREIGN PATENT DOCUMENTS

| | | |
|---|---|---|
| EP | 0 586 646 B1 | 3/1994 |
| FR | 2191010 | 6/1972 |
| FR | 2 582 343 | 5/1985 |
| GB | 1 410 461 | 10/1975 |
| JP | 06032572 A | 2/1994 |
| WO | WO 95/19485 | 7/1995 |
| WO | WO 01 18469 A1 | 3/2001 |

OTHER PUBLICATIONS

Ullner, F., "*New Generation of Cold Store Sliding Doors in the GDR*," Luft Kaeltetech v 23 n 1 1987, pp. 42-45. (German).

Saino, Joseph Neuhoff, "*Industrial Doors: The Types and Uses*," The Construction Specifier v 41 n 3 Mar. 1988, pp. 76-77, 79-81.

Macpherson, Allan, "*Failings in fire doors*," Fire Prev n 251 Jul.-Aug. 1992, pp. 25-28.

Product Catalog, "*Jamison Sound Reduction Special Purpose Cold Storage Doors*," 08300/JAM—BuyLine 0537, Jamison Door Company 1988, 8 pages.

*Product Literature, Therm-L-Tee Systems Inc.*, 5 pages.

Kason 8200 SPACE$SAVER™ Sliding Doorware® "*What a Difference Doorware® Can Make to a Foodservice Bottom Line*," © 2001, 6 pages.

Product Catalog, "*Thermo Isolierende Tursysteme*". Preisliste 1996, Manifatture Tecnolegno Hartz, 32 pages (including front & back covers).

* cited by examiner

PANEL GUIDE AND IMPACT SEPARATION SYSTEM FOR A SLIDING DOOR

RELATED APPLICATIONS

This application claims the benefit of U.S. Provisional Application No. 60/341,408, filed Dec. 14, 2001.

TECHNICAL FIELD

The invention relates to a panel guide and impact separation system for an industrial door, and more particularly to a system for a high-speed, sliding industrial door.

BACKGROUND OF THE INVENTION

Sliding doors have been used for many years to secure various enclosures, including those for cold storage facilities in manufacturing plants, warehouses, garages, and other industrial rooms. It is known in the art that door panels used in connection with such rooms are constructed from light-weight foam. The light-weight foam panels provide the insulation necessary to maintain the temperature objectives of such rooms. Such panels also permit the doors to be opened and closed at high speeds, thereby minimizing exposure of the contents of the room while the door is opened.

Inherent to doors used in connection with cold-storage applications are problems associated with air pressure differentials across opposite faces of the door. These differentials tend to push the door panels inward or outward and away from the walls surrounding the door. Air pressure differentials created by a rapidly actuated panel can displace a relatively light panel out of its normal plane of travel. This can result in improper positioning of the door when it reaches its closed position, thereby creating problems with properly sealing the doorway. This can also result in wear and ultimately damage to the hardware associated with the door, including the overhead track.

Systems such as those in U.S. Pat. No. 6,330,763 to Kern et al. have been developed in an attempt to address some of the issues described above. However, there still exists limitations inherent to such systems. For example, the cord and ring system in Kern et al. does not provide sufficient rigidity to ensure proper sealing of the leading edge of the panels as the door moves to a closed position. Moreover, the system in Kern et al. does not hold the hold panel close to the wall through its entire path of travel.

The present invention is provided to solve the problems discussed above and other problems, and to provide advantages and aspects not provided by prior doors of this type.

SUMMARY OF THE INVENTION

According to one aspect of the present invention, a panel guide and impact separation system for a sliding door is provided. The door is of the type that is adapted to open and close an opening having an upper and lower extent. The system comprises a guide, a guide follower and an elongate beam. The guide is adapted to be mounted to a mounting surface located between the upper and lower extent. The guide follower is disposed in operable engagement with the guide and is adapted to translate along at least a portion of the guide. The elongate beam has a first and second end. The first end of the elongate beam is connected the guide follower, and the second end of the elongate beam is attachable to a door panel. The second end of the elongate beam is adapted to extend generally horizontally along at least a portion of a vertical plane of a door panel.

According to another aspect of the present invention, a sliding door is provided. The door comprises a door panel having a top, a bottom, a leading edge and a trailing edge. The door panel is adapted to translate laterally relative to the opening between a closed position and an open position. The door also includes a guide mounted to a mounting surface located between the upper and lower extent of the opening. The door further has a guide follower pivotally attached to the door panel. The guide follower is disposed in operable engagement with the guide and is pivotally biased around an axis parallel to the lateral translation of the door.

According to yet another aspect of the present invention, the guide follower is comprised of a retention block and a retention tab. The retention block has a first and second end. A throughway is disposed proximate the first end and provides a pivot point for pivotable connection of the guide follower to a door panel. The retention tab has a first end and a second end. The first end of the retention tab is connected proximate the second end of the retention block. The second end of the retention tab extends generally perpendicular to the retention block and has a channel formed therein proximate a distal end. The channel engages the guide and allows for translation of the guide follower therealong.

These and other objects and advantages will be made apparent from the following description of the drawings and detailed description of the invention.

DETAILED DESCRIPTION

Figure 1:
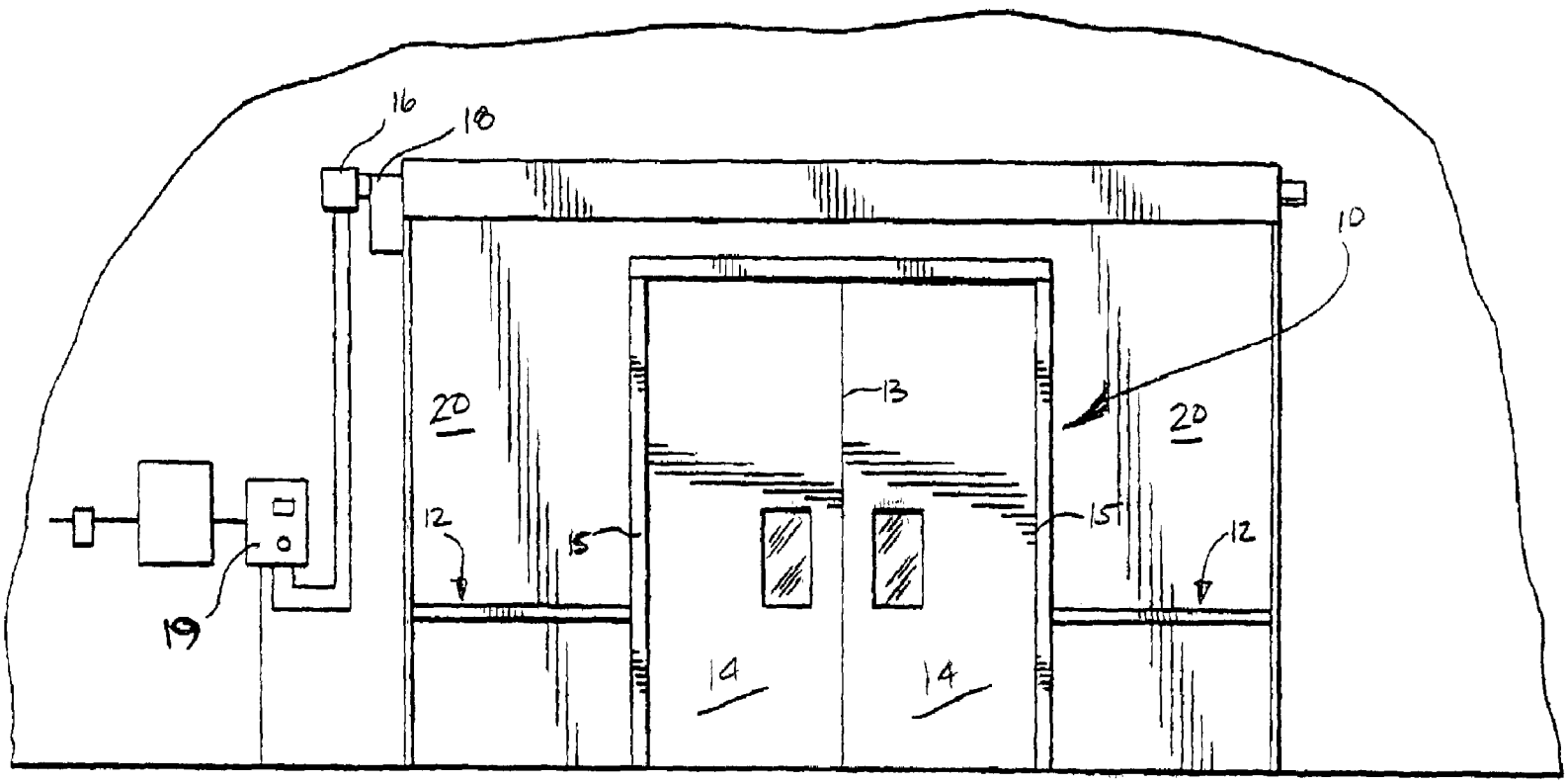
FIG. 1 is a front view of a sliding door and panel guide and impact separation system according to the present invention.

While this invention is susceptible to embodiment in many different forms, there is shown in the drawings, and will herein be described in detail, preferred embodiments of the invention with the understanding that the present disclosure is to be considered as an exemplification of the principles of the invention and is not intended to limit the broad aspect of the invention to the embodiments illustrated.

The present invention is generally directed to a sliding door 10 which incorporates a panel guide and impact separation system 12 (hereinafter, "the guide system 12"). FIG. 1 shows an automatic bi-parting sliding door 10 incorporating the guide system 12 of the present invention. As shown in FIG. 1 the door 10 is generally installed about an opening. "Opening" generally refers to any passage or throughway defined in a general manner by a upper extent, a lower extent and one or more wall edges or other frame-like structures. It is contemplated that opening with which the present invention is employed be a doorway as typically found in a wall of a building or the like. However, the present door can also be installed in a vestibule, which extends away from a doorway. Such vestibules are typically used in applications where it is necessary to minimize the exposure of an interior space to rapid fluctuations in pressure, temperature or other environmental considerations.

The door 10 with which the guide system 12 is used generally comprises at least one door panel 14. As seen in FIG. 1, each door panel 14 has a leading edge 13 and a trailing edge 15, and is adapted to laterally translate along a plane relative to the opening between an open position and a closed position. According to the present invention, the door panels 14 have a substantially linear opening and closing direction of travel. However, it is contemplated that the travel of the door panels 14 between the open and closed positions may be slightly non-linear to compensate for seals on the leading edge 13 of the door 10 or for other reasons deemed necessary for operation of the door 10.

Door panels 14 used in connection with the present invention may be designed in a variety of sizes and may be constructed from any number of materials. For example, in cold storage applications the door panels 14 may be made from foam or other materials suitable for maintaining cold and heat differentials on opposed sides of the panels. However, it would be readily understood by those of skill, that the present invention is not limited to use with foam door panels. Instead the present invention may be used with any door panel 14 of material suitable for a particular application, including wood, metal and various polymeric materials.

Each door panel 14 should be approximately equal to one-half the width of the opening, and of a height approximately equal to the opening height. With a single sliding door panel design, the door panel 14 is preferably of the same approximate height and width of the opening. However, the use of greater than two door panels 14 is also contemplated, and the modification of the presently disclosed invention to accommodate such design variations would naturally be readily understood by those skilled in the art after studying this disclosure, without requiring undue experimentation. Where certain applications may require, it is contemplated by the present invention that the cumulative size of all door panels 14 in a single application could be significantly less than, or significantly more than the size of the opening.

All remaining discussions will be directed to a single sliding door panel design, but it is understood that such discussion will also be applicable to multi-panel sliding door panels 14 and the particular design variations mentioned. These types of doors are well known in the art and application of the following discussion to such doors will be readily understood by those skilled in the art.

Typically, a motor 16 and a drive system 18 are employed in connection with the doors 10 described herein. Specifically, as shown in FIG. 1, a motor 16 is operably coupled to a drive system 18 for actuating the door panel 14 between the open and closed positions on an overhead track. For example, the present invention may utilize drive motor 16 of the type manufactured by SEW-Eurodrive and marketed under the trade name a SEW-Eurodrive MOVIMOT®. However, doors used in connection with the present system may employ any drive motor 16 that is capable of at least bi-directional, two-speed operation. The door of the present invention may also include a controller 19 that is in electronic communication with the motor 16. The controller 19 may be any type suitable for use with door assemblies, and which are adapted to control the starting, stopping, speed and direction of the motor 16. It is contemplated, however, that the present invention be employed in an application wherein the door panel 14 is manually moved between the opened and closed positions.

The guide system 12 of the present invention provides several advantages over prior art systems. For example, the guide system 12 disclosed herein acts to maintain the actuating door panel 14 in close proximity to the surrounding wall or mounting surface 20 throughout substantially its entire path of travel. Additionally, the guide system 12 is adapted to accommodate and incorporate breakaway features, if so desired. The guide system 12 also provides a point at which forces applied to semi-flexible door panel 14 may be concentrated and thus provides predictability in the distribution of the forces in the door. The guide system 12 and its additional advantages will now be described below in further detail.

As may be seen in FIGS. 1–14, the guide system 12 generally comprises a guide 22 and a guide follower 24. The guide 22 is mounted to a mounting surface 20 located between the upper and lower extent of the opening. As discussed above, the mounting surface 20 may be a wall surrounding a doorway, or a freestanding surface such as that used in connection with a vestibule. The guide 22 may be any surface suitable for accommodating generally linear travel of the door panel 14 between an open and closed position. For example, the guide 22 may be a plate, a rod, a bar, a u-shaped track, a v-shaped track, or a c-shaped track. The present invention, however, should not be limited to the geometric configurations specifically described or shown herein, as any geometric configuration that provides a generally linear guide path of travel for the door panel 14 may be employed without departing from the present invention.

Figure 2:
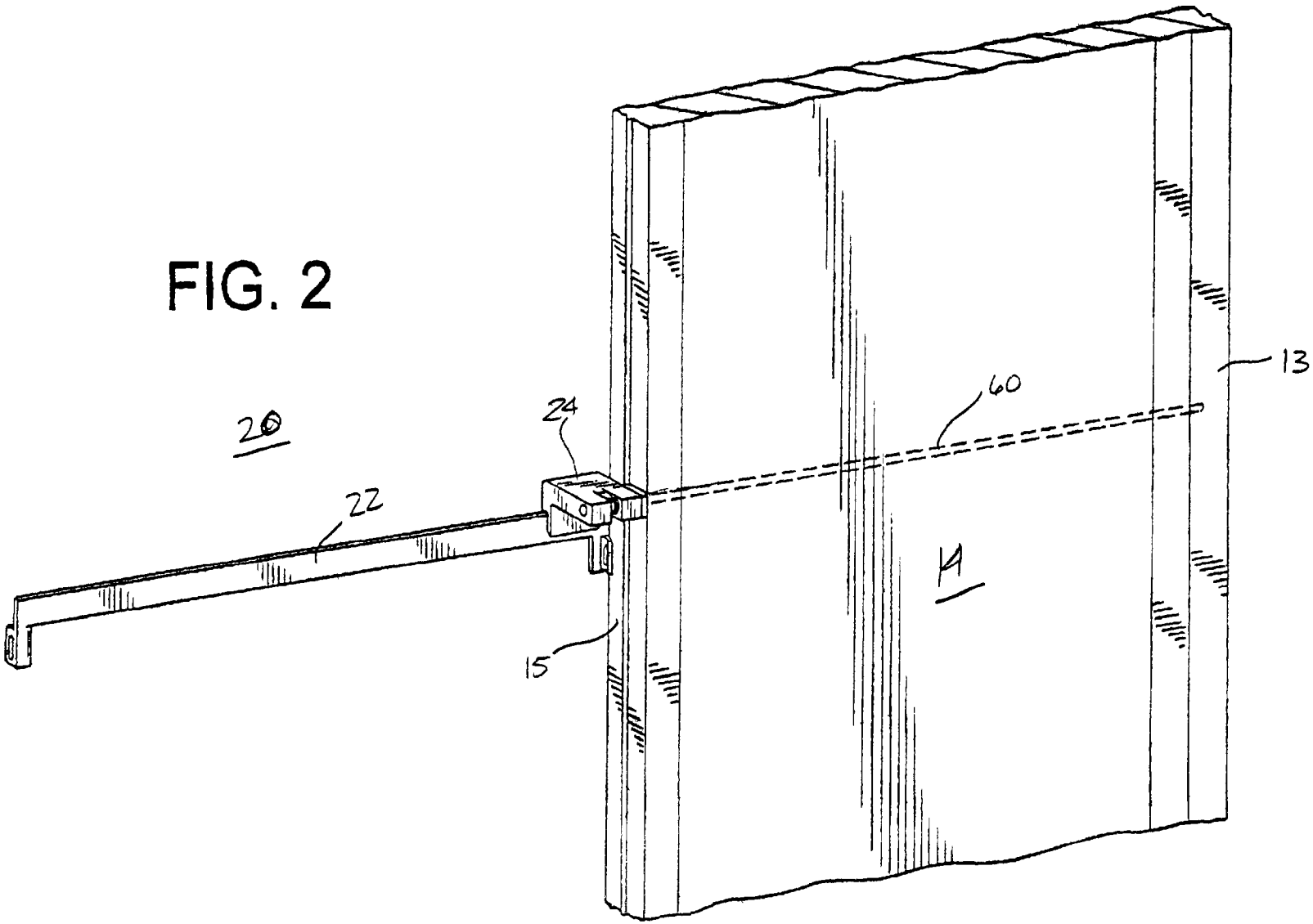
FIG. 2 is partial perspective view of a door and panel guide and impact separation system according to the present invention.
Figure 3:
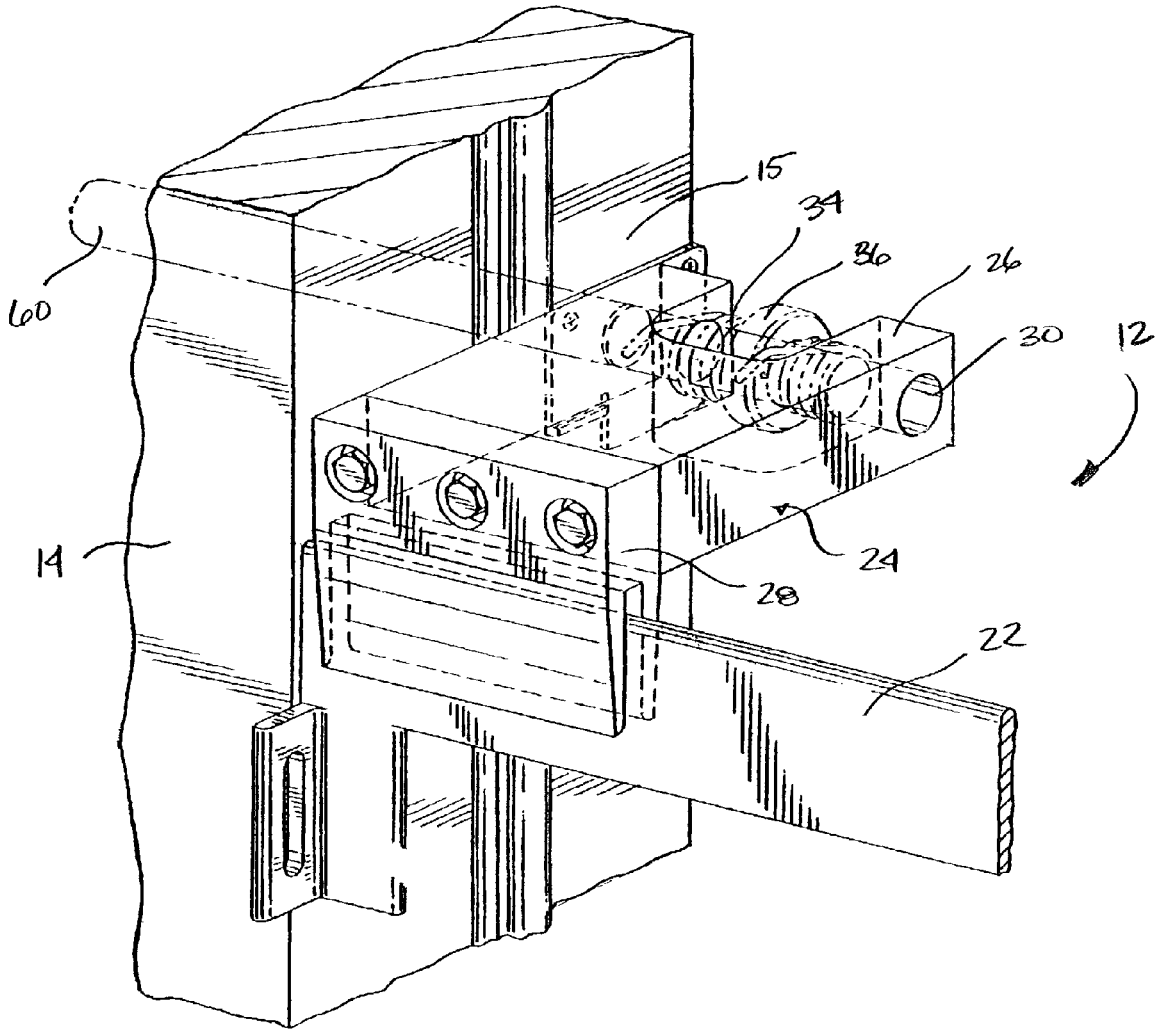
FIG. 3 is partial perspective view of a door and panel guide and impact separation system according to the present invention.
Figure 4:
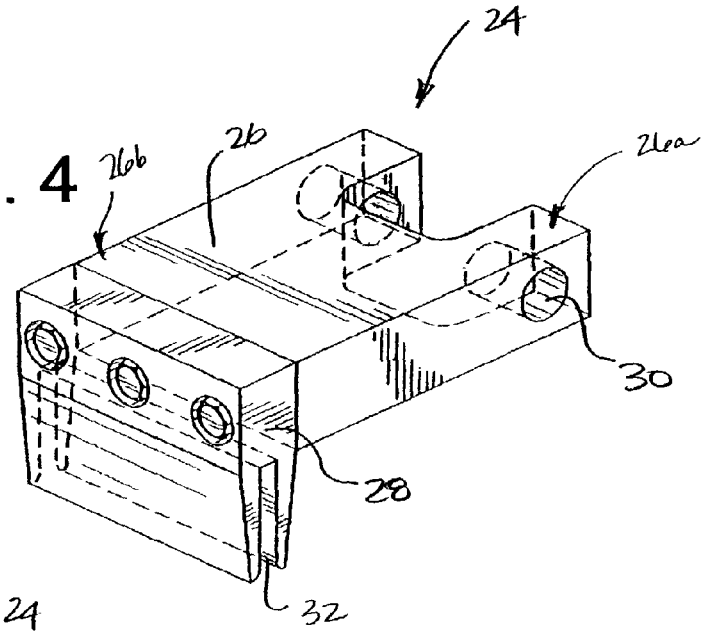
FIG. 4 is a perspective view of a guide follower according to the present invention.

As may be seen in FIGS. 2 and 3, the guide follower 24 is pivotally attached to the door panel 14. The guide follower 24 may be attached to the door panel 14 by any suitable mechanism that allows for pivoting, including a pin or other fastener. The guide follower 24 is disposed in operable engagement with the guide 22 such that, as the door moves between the open and closed positions, the guide follower 24 translates along at least a portion of the guide 22.

According to one embodiment of the present invention shown in FIGS. 2–10, the guide follower 24 is comprised of a retention block 26 and a retention tab 28. The retention block 26 has a first end 26*a*, a second end 26*b* and a throughway 30 disposed proximate the first end 26*a*. The throughway 30 provides a pivot point for pivotable connection of the guide follower 24 to the door panel 14. The retention tab 28 has a first end 28*a* and a second end 28*b*. The first end 28*a* of the retention tab 28 is connected proximate the second end 26*b* of the retention block 26. The second end 28*b* of the retention tab 28 extends generally perpendicular to the retention block 26 and has a channel 32 formed proximate its distal end. The channel 32 engages the guide 22 so that there may exist relative sliding between the guide follower 24 and guide 22. Preferably, at least the retention tab 28 is made from a low friction polymeric material to assist sliding engagement of the guide follower 24 and the guide 22.

Figure 8:
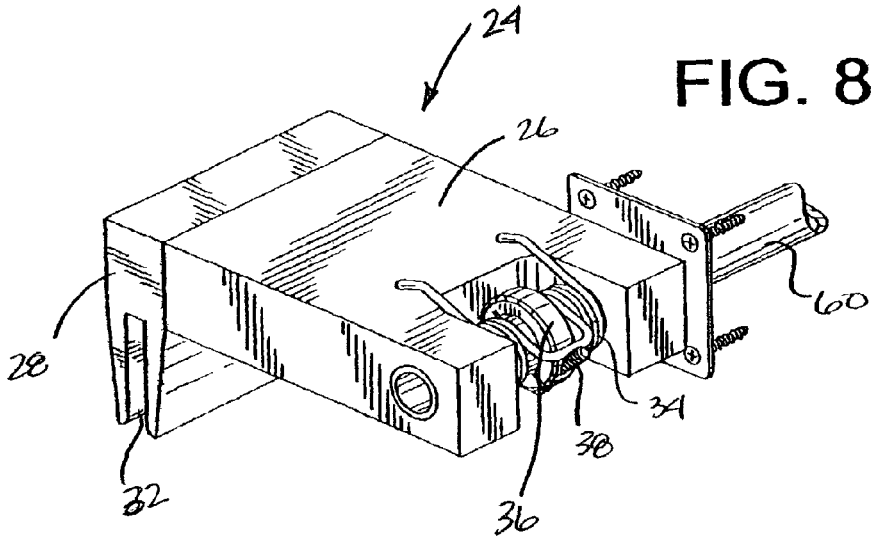
FIG. 8 is a perspective view of a guide follower in connection with a elongate beam according to the present invention.
Figure 9:
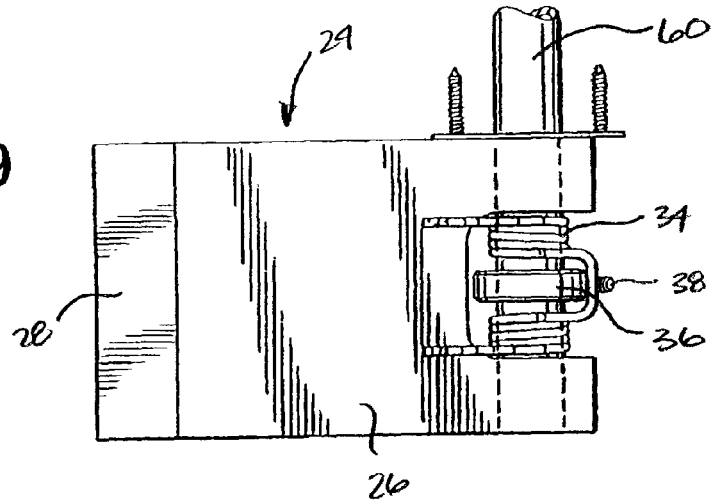
FIG. 9 is a top view of the guide follower and a elongate beam shown in FIG. 8.
Figure 10:
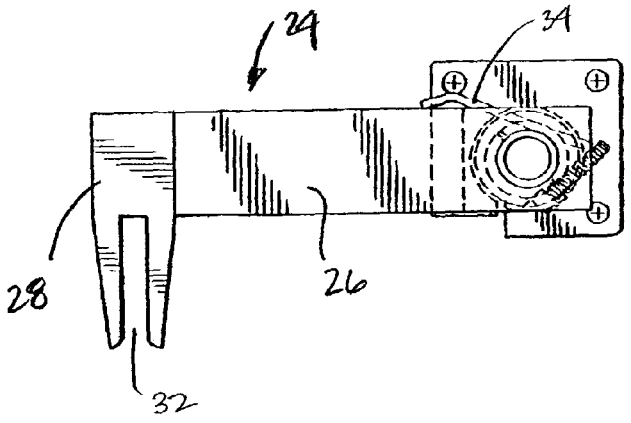
FIG. 10 is a top view of the guide follower and a elongate beam shown in FIG. 8.

The guide follower 24 is pivotally biased around an axis parallel to the lateral translation of the door, thereby forcing the guide follower 24 into operable engagement with the guide 22. This allows for substantially continuous engagement between the guide follower 24 and the guide 22 throughout the entire linear path of travel of the door panel 14. The guide follower 24 can be biased by employing a means for biasing 34. As shown in FIGS. 8–10, the means for biasing 34 is preferably a torsion spring disposed in cooperative engagement with the guide follower 24 and is secured by a clamp 36 and stop mechanism 38. It is contemplated that other biasing mechanisms may be used to bias the guide follower 24, including cams, compression springs, leaf springs, helical springs, elastomeric materials or other suitable biasing mechanisms known to those skilled in the art.

Figure 5:
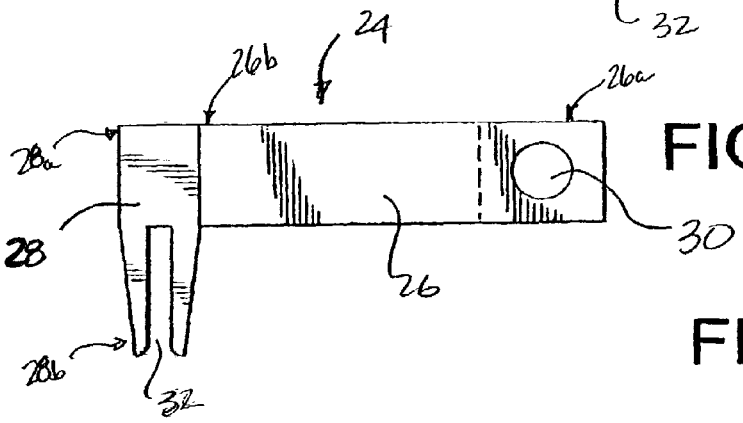
FIG. 5 is a side view of the guide follower shown in FIG. 4.
Figure 6:
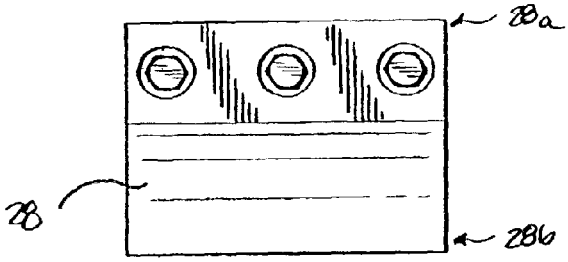
FIG. 6 is an end view of the guide follower shown in FIG. 4.
Figure 7:
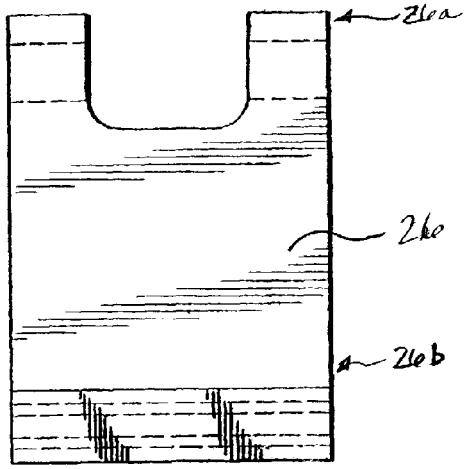
FIG. 7 is a top view of the guide follower shown in FIG. 4.

According to the present invention, the guide follower 24 is adapted to disengage the guide 22 when sufficient force is applied to the door panel 14. If the guide follower 24 includes a biasing means 34, such as is described above, the guide follower 24 will disengage the guide 22 when sufficient force is transferred to biasing means 34 to overcome the force that biases the guide follower 24 into engagement with the guide 22. To assist the guide follower 24 in releasing from the guide 22, the guide follower 24 may be made from a semi-flexible polymeric material. According to one embodiment of the present invention, at least the second end of the retention tab 28 is sufficiently flexible to permit the guide follower 24 to disengage the guide 22 upon receiving an impact in excess of a predetermined force. As shown in FIGS. 5 and 10, the second end of the retention tab 28 may also be tapered. By tapering the second end of the retention tab 28, less material surrounds the channel 32, thus assisting the retention tab 28 in flexing so that guide follower 24 may more easily disengage the guide 22 upon impact to the door panel 14.

Figure 11:
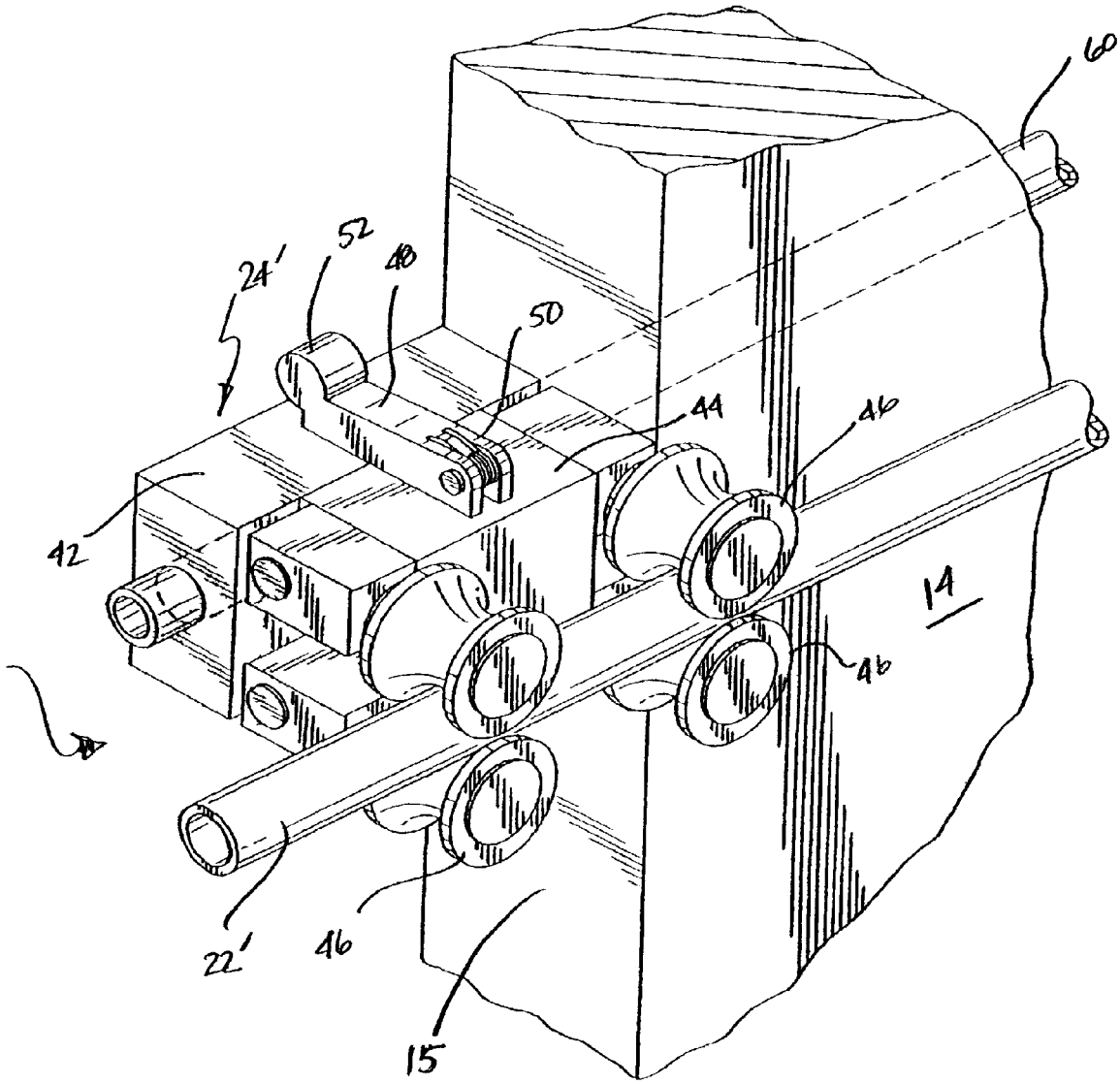
FIG. 11 is partial perspective view of a door and another embodiment of a panel guide and impact separation system according to the present invention.
Figure 12:
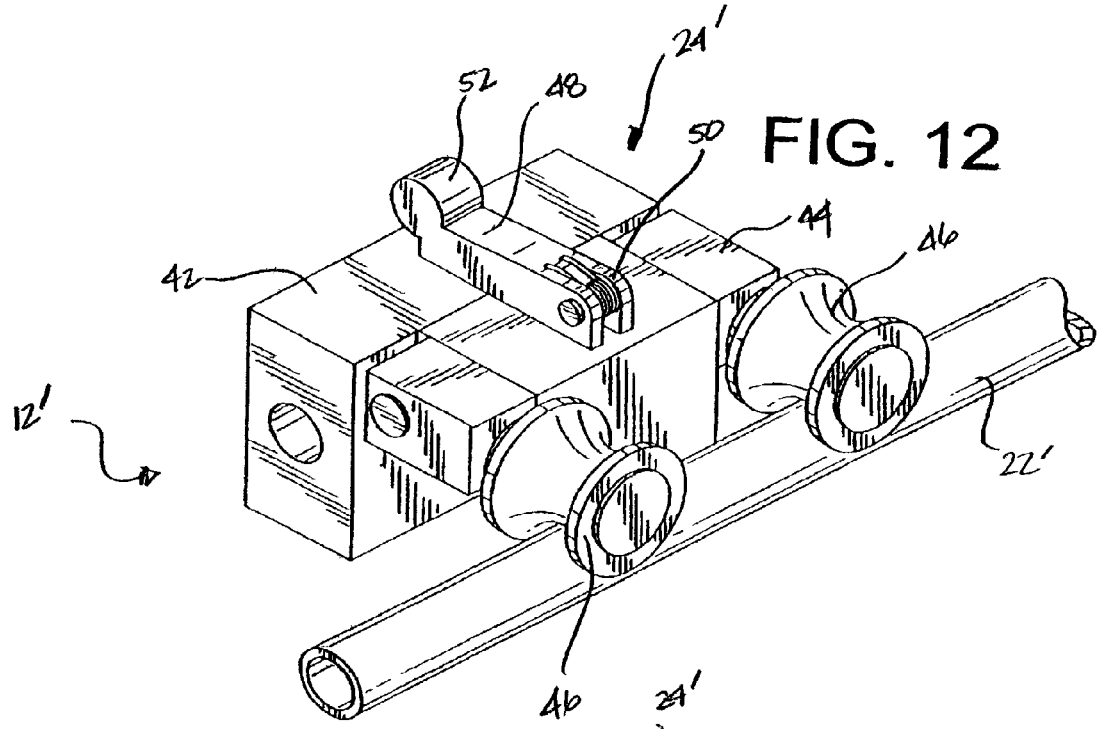
FIG. 12 is partial perspective view of another embodiment of a panel guide and impact separation system according to the present invention.
Figure 13:
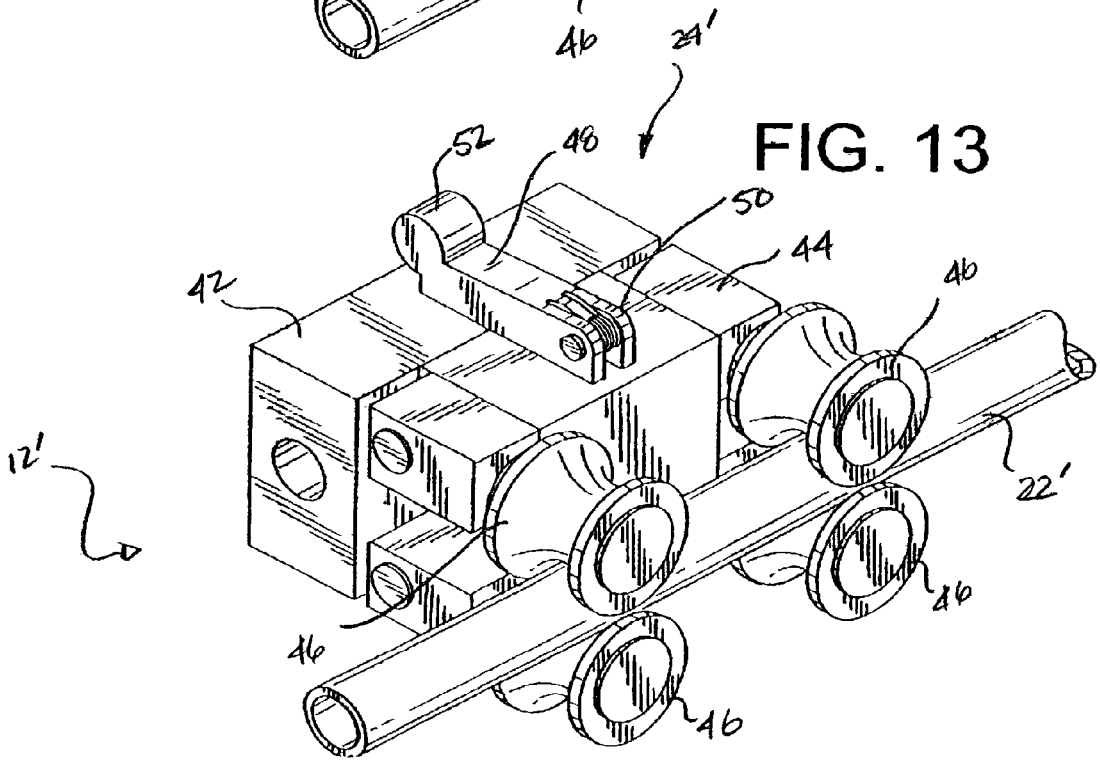
FIG. 13 is partial perspective view of another embodiment of a panel guide and impact separation system according to the present invention; and, FIG. 14 is partial perspective view of a door and another embodiment of a panel guide and impact separation system according to the present invention.

FIGS. 11–13 illustrate another embodiment of a guide follower 24' that may be used in connection with a guide system 12' of the present invention. As shown in FIGS. 11–13, the guide follower 24' comprises a trolley 40. The trolley 40 generally includes a retention block 42 and a roller assembly block 44. The retention block 42 is attached to the trailing edge 15 of the door and the roller assembly is coupled to the retention block 42. According to the present invention, the roller assembly block 44 has at least one roller 46 operably disposed thereon. In one embodiment shown in FIG. 13, the roller assembly block 44 has a plurality of rollers 46, and at least two of the plurality of rollers 46 engage the guide 22' on opposed sides of the guide 22' so that a channel is formed between the rollers 46. The rollers 46 are preferably made from a low friction polymeric material to assist the guide follower 24' in rolling with on the guide 22'.

The guide follower 24' may also include a resilient material (not shown) disposed between the block and roller assembly. In one embodiment, a tensioning arm 48 having a pivoting end 50 and a locking end 52 is attached to either the retention block 42 or the roller assembly block 44. A clasp adapted to receive the locking end 52 of the tensioning arm 48 is attached to the other of the retention block 42 and the roller assembly block 44. According to this configuration, the retention block 42 and roller assembly block 44 may be connected one to the other by the tensioning arm 48. When the locking end 52 of the tensioning arm 48 is fastened to the clasp, the roller assembly block 44 is drawn closer to the retention block 42. The resilient material, however, is of sufficient thickness and resiliency such that when it is compressed, the resilient material creates a resistant force between the retention block 42 and the roller assembly block 44.

The rollers 46 of this embodiment of the guide follower 24' may be press fit on their respective roller mounts such that when a force in excess of a predetermined force is applied to a door panel 14 to which this guide follower 24' is connected, the rollers 46 separate from the trolley 40. Alternatively, the guide follower 24' may be configured such that the rollers 46 remain attached upon application of a predetermined force to the door panel 14, but the retention block 42 separates from the roller assembly block 44.

Figure 14:
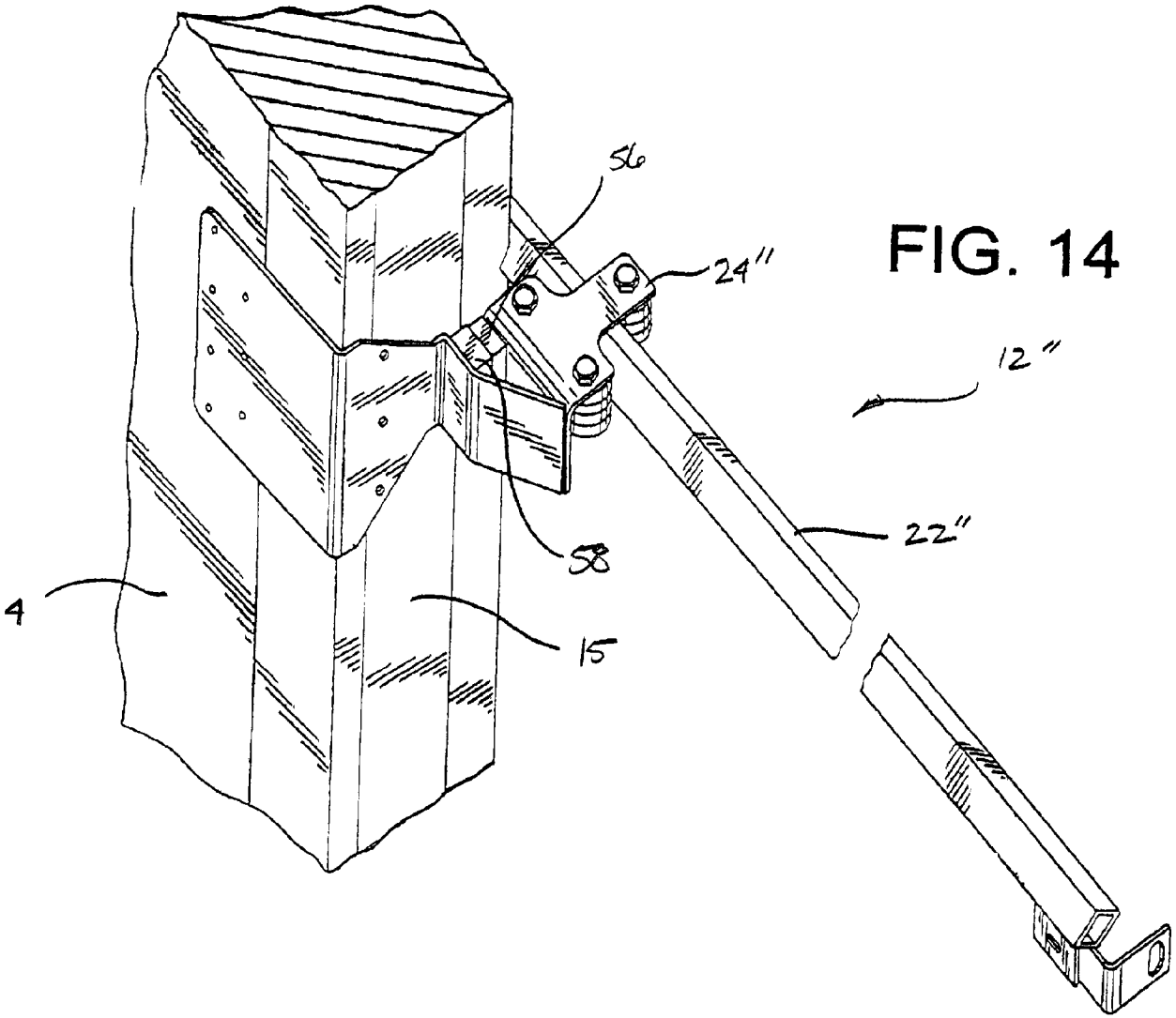

According to another embodiment of the guide system 12" shown in FIG. 14, a magnet 56 is attached to either the guide follower 24" or the door panel 14. A magnet attracter 58 is attached to the other of the guide follower 24" and the door panel 14. The magnet 56 magnetically engages the attracter 58 and couples the guide follower 24" to the door panel 14. The magnet 56 is separable from the magnet attracter 58 upon an impact to the door panel 14 in excess of a predetermined force, thereby permitting the panel 14 to separate from the guide follower 24".

As shown in FIGS. 2, 3 and 11, the present invention can include an elongate beam 60 which is attached to the door panel 14 between the top and the bottom of the door panel 14. A first portion of the elongate beam 60 extends generally horizontally along a vertical plane of the door panel 14. A second portion of the elongate beam 60 extends away from the leading edge 13 of the door panel 14 and beyond the trailing edge 15 of the door panel 14. Thus, the elongate beam 60 effectively functions as an "outrigger" for the door panel 14. The second portion of the elongate beam 60 operably engages the guide 22, 22', 22". It is contemplated that the second portion of the elongate beam 60 engages the guide 22, 22', 22" directly or, as shown in FIGS. 3 and 11, by attaching one of the above described guide followers 24, 24', 24" proximate the distal second portion of the elongate beam 60. The elongate beam 60 may have any geometric cross-section without departing from the invention, including for example a cylindrical rod or a rectangular beam. Furthermore, it will be apparent to those of skill that the elongate beam 60 may be of any size suitable for the application with which the door 10 is being use.

In one embodiment, the elongate beam 60 extends across substantially the entire vertical plane of the door panel 14. However, it is contemplated by the present invention that the elongate beam 60 extend across less than the entire vertical plane of the door panel 14. The extent to which the elongate beam 60 extends across the door panel 14 will be dictated by the specific application with which the invention is being used, as well as by the size, material and construction of the door panel 14. It will be readily understood by those of skill in the art, however, that any configuration in which some portion of the beam extends across at least a portion of the vertical plane of the panel, and some portion of the elongate beam 60 extends beyond the trailing edge 15 of the door panel 14 will be suitable for the present invention.

According to one embodiment of the present invention shown in FIGS. 2, 3 and 11, the first portion of the elongate beam 60 extends through the core of at least a portion of the door panel 14 and the second portion of the elongate beam 60 extends out of the trailing edge 15 of the door panel 14. For example, in door systems which employ semi-flexible door panels 14 such as those formed of foam, the elongate beam 60 serves to provides stiffness to the door panel 14. Accordingly, the door panel 14 is not only imparted with a degree of stiffness to withstand impact, but the elongate beam 60 also provides improved stiffness to assist in aligning leading edge 13 seals or the like during opening and closing of the door panel 14.

The elongate beam 60, as used in connection with flexible or semi-flexible door panels 14, also provides a point at which impact forces may be concentrated. This provides predictability in the distribution of the forces in the door, thereby allowing a reliable breakaway mechanism. Additionally, the elongate beam 60 acts to ameliorate stress at the connection between the door panel 14 and the guide system 12, 12', 12" by moving the stress point away from the panel edge to the breakaway mechanism associated with the guide system 12, 12', 12". In so doing, the elongate beam 60 provides integrity to the connection of the door panel 14 to the guide system 12, 12', 12". The elongate beam 60 also reduces damage to the overhead track and minimizes derailment of the door panels 14 from the overhead tracks.

While the specific embodiments have been illustrated and described, numerous modifications come to mind without significantly departing from the spirit of the invention and the scope of protection is only limited by the scope of the accompanying Claims.

What is claimed is:

1. A panel guide and impact separation system for a sliding door adapted to open and close an opening, the opening having an upper and lower extend, the panel guide and impact separation system comprising:

a guide adapted to be mounted to a mounting surface located between the upper and lower extent;

a guide follower disposed in operable engagement with the guide, wherein the guide follower is adapted to translate along at least a portion of the guide;

an elongate beam having a first and second end, the first end of the elongate beam being connected to the guide follower and the second end of the elongate beam being attachable to a door panel and adapted to extend generally horizontally along at least a portion of a vertical plane of a door panel; and, a torsion spring disposed in cooperative engagement with the first end of the elongate beam and with the guide follower, wherein the torsion spring biases the guide follower into engagement with the guide such that the guide follower is adapted to disengage the guide upon application of a force sufficient to overcome the force applied by the torsion spring.

2. The system of claim 1, wherein the second end of the elongate beasm is adapted to extend into a trailing edge of a door panel and generally horizontally through at least a portion of a vertical panel of the door panel.

3. The system of claim 1, wherein the guide follower comprises:

a retention block having a first end and a second end, the retention block having a throughway disposed proximate the first end and along an axis parallel to translational movement of the guide follower relative to the guide, wherein the throughway receives the elongate beam; and a retention tab having a first end and a second end, the first end of the retention tab being connected proximate the second end of the retention block, the second end of the retention tab extending generally perpendicular to the retention block and having a channel proximate a distal end for slidably engaging the guide.

4. The guide follower of claim 3, wherein the second end of the retention tab is sufficiently flexible to permit the guide follower to disengage the track upon impact of a force in excess of a predetermined force.

5. The system of claim 1, wherein the guide follower comprises a trolley, the trolley comprising at least one roller adapted to rollingly engage the guide.

6. The system of claim 5, wherein the at least one roller is separable from the trolley when a force in excess of a predetermined force is applied.

7. The system of claim 5, wherein the trolley comprises a plurality of rollers, wherein at least two of the plurality of rollers engage the guide on opposed sides of the guide.

8. The system of claim 7, wherein the rollers are separable from the trolley when a force in excess of a predetermined force is applied.

9. The system of claim 5, wherein the trolley comprises a retention block connected to the elongate beam and a roller assembly block coupled to the retention block, the at least one roller is operably disposed on the roller assembly block.

10. The system of claim 9, further comprising:

a resilient material disposed between the retention block and roller assembly block;

a tensioning arm having a pivoting end and a locking end; and a clasp adapted to receive the locking end of the tensioning arm, wherein the pivoting end is pivotally connected to one of either the retention block and the roller assembly and the clasp being attached to the other of either the retention block and the roller assembly block.

11. The system of claim 10, wherein the retention block is separable from the roller assembly block when a force in excess of a predetermined force is applied.

12. A sliding door for selectively opening and closing an opening, the opening having an upper and lower extent, the door comprising:

a door panel having a top, a bottom, a leading edge and a trailing edge, the door panel being adapted to translate laterally relative to the opening between a closed position and an open position;

a guide mounted to a mounting surface located between the upper and lower extent of the opening;

a guide follower disposed in operable engagement with the guide, the guide follower being adapted to translate along at least a portion of the guide;

an elongate beam having a first and second end, the first end of the elongate beam being connected to the guide follower, and the second end of the elongate beam being attached to the door panel and extending generally horizontally along at least a portion of a vertical plane of the door panel; and, a torsion spring disposed in cooperative engagement with the first end of the elongate beam and with the guide follower, wherein the torsion spring biases the guide follower into engagement with the guide such that the guide follower is adapted to disengage the guide upon application of a force sufficient to overcome the force applied by the torsion spring.

13. The door of claim 12, wherein the second end of the elongate beam extends into the trailing edge of the door panel and generally horizontally through at least a portion of the vertical plane of the door panel.

14. The door of claim 13, wherein at least the core of the door panel is made from semi-flexible foam.

15. The door of claim 12, further comprising:

a magnet attached to one of either the guide follower and the door panel; and, a magnetic attracter attached to the other of the guide follower and the door panel, the magnet magnetically engaging the magnet attracter and coupling the guide follower to the door panel, the magnet being separable from the magnet attracter upon an impact to the panel in excess of a predetermined force.

16. The door of claim 12, wherein the guide follower comprises:

a retention block having a first end and a second end, the retention block having a throughway disposed proximate the first end and along an axis parallel to translational movement of the guide follower relative to the guide, wherein the throughway receives the elongate beam; and, a retention tab having a first end and a second end, the first end of the retention tab being connected proximate the second end of the retention block, the second end of the retention tab extending generally perpendicular to the retention block and having a channel proximate a distal end for slidably engaging the guide.

17. The door of claim 16, wherein at the second end of the retention tab is sufficiently flexible to permit the guide follower to disengage the track upon receiving an impact in excess of a predetermined force.

18. The system of claim 12, wherein the guide follower comprises a trolley, the trolley comprising at least one roller adapted to rollingly engage the guide.

19. The system of claim 18, wherein the at least one roller is separable from the trolley when a force in excess of a predetermined force is applied.

20. The system of claim 18, wherein the trolley comprises a plurality of rollers, wherein at least two of the plurality of rollers engage the guide on opposed sides of the guide.

21. The system of claim 20, wherein the rollers are separable from the trolley when a force in excess of a predetermined force is applied.

22. The system of claim 18, wherein the trolley comprises a retention block connected to the elongate beam and a roller assembly block coupled to the retention block, the at least one roller is operably disposed on the roller assembly block.

23. The system of claim 22, further comprising:

a resilient material disposed between the retention block and roller assembly block;

a tensioning arm having a pivoting end and a locking end; and a clasp adapted to receive the locking end of the tensioning arm, wherein the pivoting end is pivotally connected to one of the either the retention block and the roller assembly and the clasp being attached to the other of either the retention block and the roller assembly block.

24. The system of claim 23, wherein the retention block is separable from the roller assembly block when a force in excess of a predetermined force is applied.

25. The door of claim 12, further comprising:

a motor operably coupled to a drive system, wherein the drive system and motor move the door panel between the open and closed positions; and, a controller in electronic communication with the motor, the controller for controlling the starting, stopping, speed and direction of the motor.

26. A sliding door for selectively opening and closing an opening, the opening having an upper and lower extent, the door comprising:

a door panel having a top, a bottom, a leading edge and a trailing edge, the door panel being adapted to translate laterally relative to the opening between a closed position and an open position;

a guide mounted to a mounting surface located between the upper and lower extent of the opening; and, a guide follower pivotally attached to the door panel and disposed in operable engagement with the guide, the guide follower being pivotally biased by a torsion spring around an axis parallel to the lateral translation of the door.

27. The door of claim 26, wherein the guide follower is adapted to disengage the guide upon application of a force sufficient to overcome the biasing force.

28. The door of claim 26, wherein the guide follower comprises:

a retention block having a first end and a second end, the retention block having a throughway disposed proximate the first end and along an axis parallel to the translational movement of the guide follower relative to the guide, wherein the throughway receives the elongate beam; and, a retention tab having a first end and a second end, the first end of the retention tab being connected proximate the second end of the retention block, the second end of the retention tab extending generally perpendicular to the retention block and having a channel proximate a distal end for slidably engaging the guide.

29. The door of claim 28, wherein at the second end of the retention tab is sufficiently flexible to permit the guide follower to disengage the track upon receiving an impact in excess of a predetermined force.

* * * * *

UNITED STATES PATENT AND TRADEMARK OFFICE

CERTIFICATE OF CORRECTION

PATENT NO. : 7,117,637 B2
APPLICATION NO. : 10/320323
DATED : October 10, 2006
INVENTOR(S) : Delgado et al.

It is certified that error appears in the above-identified patent and that said Letters Patent is hereby corrected as shown below:

Column 7, line 60, “beasm” should read --beam--

Signed and Sealed this

Ninth Day of January, 2007

JON W. DUDAS
*Director of the United States Patent and Trademark Office*